US005787643A

United States Patent [19]

Schmuck

[11] Patent Number: 5,787,643

[45] Date of Patent: Aug. 4, 1998

[54] WINDOW WITH LATCH ASSEMBLY

[75] Inventor: Leroy C. Schmuck, Kendalville, Ind.

[73] Assignee: Excel Industries, Ltd., Elkhart, Ind.

[21] Appl. No.: 538,717

[22] Filed: Oct. 3, 1995

[51] Int. Cl.[6] ..... E05B 65/10

[52] U.S. Cl. ..... 49/141; 49/394

[58] Field of Search ..... 49/141, 394; 292/210, 292/216, DIG. 6, DIG. 7

[56] References Cited

U.S. PATENT DOCUMENTS

| | | | |
|---|---|---|---|
| 2,639,790 | 5/1953 | Reitzel | 49/141 |
| 3,942,286 | 3/1976 | Ehret et al. . | |
| 4,186,953 | 2/1980 | O'Connor | 49/141 |
| 4,313,280 | 2/1982 | Ehret et al. . | |
| 4,879,842 | 11/1989 | Bailey | 49/141 |
| 5,127,686 | 7/1992 | Gleason et al. | 292/216 |
| 5,234,238 | 8/1993 | Takimoto | 292/216 |
| 5,273,324 | 12/1993 | Kobayashi | 292/216 |
| 5,439,260 | 8/1995 | Weinerman et al. | 292/216 |
| 5,440,849 | 8/1995 | Agrawal et al. . | |
| 5,441,338 | 8/1995 | Kane et al. . | |
| 5,443,673 | 8/1995 | Fisher et al. . | |

*Primary Examiner*—Anthony Knight
*Assistant Examiner*—Curtis Cohen
*Attorney, Agent, or Firm*—Banner & Witcoff, Ltd.

[57] ABSTRACT

A window assembly has a latch assembly of enhanced strength. The latch assembly is mounted to the frame of the window assembly. A latch member is biased by a torsion spring towards a non-latching position, a latch-lock member is biased by a second torsion spring towards a non-locking position. The latch member engages a striker pin mounted to a base wall to secure the window in its normal, closed position. The latch-lock, latch member and striker pin are held together by the torsion springs and a series of detents on the latch-lock member and the latch member. A release bar is hingedly mounted to the latch assembly and moveable from a normal, closed, non-releasing position to an open, releasing position. Operation of the release bar forces a connection to actuate a trip lever, which in turn forces a latch-lock to rotate, sequentially disengaging the latch-lock detents from the latch member detents, thereby disengaging the latch member detent from the striker pin, allowing the window to open. In one embodiment the connection is a flange of a release bar hinge with a cam surface which forces a trip lever down to disengage the striker pin from the latch assembly. In a second embodiment the connection is a bracket attached to the release bar and provided with a slot, with a connecting rod sidably connected at one end to the bracket in the slot, and at the other end attached to the trip lever. Operation of the release bar forces the trip lever up to disengage the striker pin from the latch. In the second embodiment, the release bar can be moved to an intermediate position without the connection engaging the latch to release the striker pin.

25 Claims, 8 Drawing Sheets

WINDOW WITH LATCH ASSEMBLY

FIELD OF THE INVENTION

This invention relates to improvements in a latching assembly for windows and more particularly for windows commonly used on buses, railroad passenger cars or other mass transit vehicles.

BACKGROUND

Window construction designs for a passenger vehicle such as a bus or railroad passenger car can provide means of exiting the vehicles with minimum effort and minimum loss of time. Typically such windows include a framed panel hinged to the wall of the vehicle, and a latch assembly. The window can be quickly unlocked or disengaged and allowed to pivot outward, allowing a passenger to leave the vehicle by way of the window. These latching window assembly designs must meet stringent test specifications to hold the window in place under substantial loading, they must provide a watertight seal, and they must minimize vibrational noise.

Various latch mechanisms are known in the prior art. For example, U.S. Pat. No. 3,942,286 teaches the use of a latch assembly comprising a release bar hingedly mounted to the frame of a window. The release bar has a contoured socket. A keeper bar is formed with an elongate bead of cylindrical configuration. The release bar is snap fitted over the keeper. Lifting the release bar allows the window to be opened.

A problem arose during assembly of the latch mechanism to the vehicle. Because of the improper initial settings during assembly, the keeper mechanism would not always fit snugly to the release bar. To compensate for this U.S. Pat. No. 4,313,280, assigned to the assignee of the instant application, allowed adjustment of the keeper with a pair of set screws.

Another known window assembly design teaches the use of a keeper mounted to a wall, a release bar with a show surface mounted to a lower frame of the window assembly and a release bar retention block to hold the release bar in an up position, keeping the release bar from contacting the wall and possibly damaging the show surface of the release bar when the window is pivoted.

A problem with these designs is that the latch assembly is dependent on a tight fit between the release bar and a keeper mechanism. If the lower frame assembly becomes damaged, dented or crushed due to an impact, or if the parts are not dimensioned or produced accurately, the keeper may not fully engage the release bar resulting in rattling, and an imperfect seal.

It is an object of the present invention to provide a window with an improved latch assembly having enhanced latch strength.

It is another object of at least certain preferred embodiments of the present invention to provide an improved release bar retention means, to prevent scuffing or scratching of the interior or show surface of the release bar.

It is another object of at least certain preferred embodiments of the present invention to provide a window assembly with an improved latch assembly such that the window can be closed and a latch member engaged without returning the release bar to its full down position.

Additional objectives will become apparent from the following disclosure.

SUMMARY OF THE INVENTION

In accordance with a first aspect, a window assembly is provided with a latch assembly mounted on a frame of the window pane or panel. The latch assembly has a latch member which can move between a latching position and a non-latching position, a torsion spring biasing the latch member towards its non-latching position, a latch-lock member, which releasably locks the latch member, moving between a locking position and a non-locking position and a second torsion spring, which biases the latch-lock member towards its non-locking position. Operation of a release bar from a non-releasing position to a releasing position actuates the latch-lock member via connection means to release the latch member and allow the window to open.

It is particularly advantageous feature of the invention that the latch member is provided with a latch detent formed by a pair of projections, which wraps around part of a fixed member, providing excellent latch strength. These and other advantages will be better understood in view of the detailed description provided below of certain preferred embodiments.

BRIEF DESCRIPTION OF THE DRAWINGS

Certain preferred embodiments are described below with reference to the appended drawings wherein.

Figure 1:
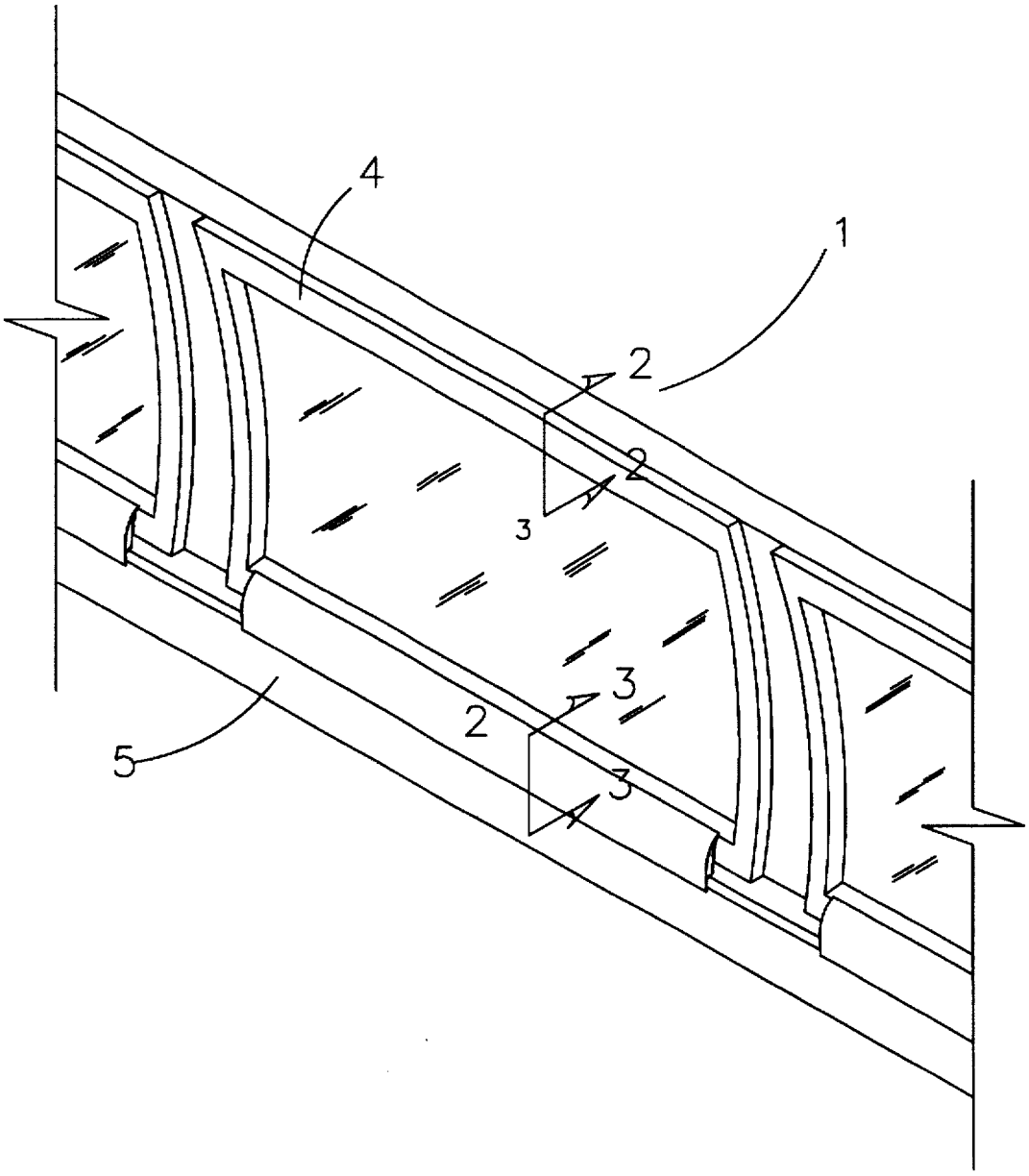
FIG. 1 is a perspective view of a hinged window assembly with a latching mechanism.

The same reference numeral is used for a given feature or element in each drawing in which it appears. It should be understood that the drawings are somewhat schematic and not necessarily to scale, to permit greater clarity in the disclosure and description of the invention. All directional references appearing in the discussion below refer to the orientation shown in the drawings unless stated otherwise. It should be understood, however, that the window assembly discussed here can be used in many different applications and orientations involving, vertical or horizontal hinged window assemblies, etc.

DETAILED DESCRIPTION OF CERTAIN PREFERRED EMBODIMENTS

It will be understood by those who are skilled in this area of technology that the window assemblies disclosed and described herein are suitable for use in numerous applications, including mass transit cars and passenger vehicles. For purposes of illustration, various preferred and alternative features and aspects of the invention are now described in the context of a hinged window for a bus. It should be understood, however, that the invention is not limited to this particular application, either in general or as to its particular features and elements.

Figure 2:
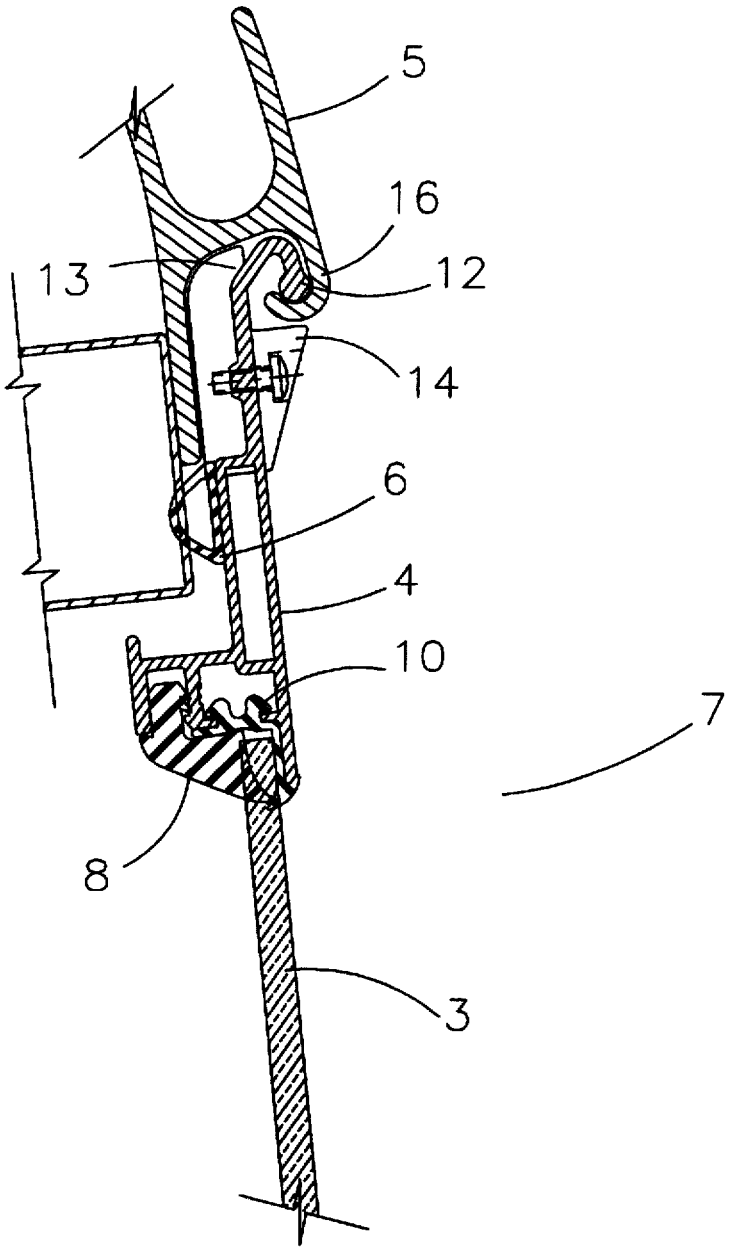
FIG. 2 is a cross sectional view of the hinge assembly, taken through line 2—2 of FIG. 1.

In the preferred embodiment shown in FIGS. 1 and 2, window assembly 1 has a window subassembly 7, having a transparent panel or pane 3, most preferably made of glass, plastic or a multilayer combination of the two, a frame 4 positioned to fill an opening in a wall 5, extending along at least a portion of a peripheral edge of the panel, most preferably either injection molded thermoplastic or a structural metal frame and a pair of interference fit seals 8, 10, and a hinge 13 comprising a U-shaped flange 12 preferably extending unitarily from the frame 4. The end of the flange is preferably rounded or cylindrical in shape and to facilitate pivotable movement of the window the flange 12 is positioned in a hook shaped flange 16 extending from the wall. When the window subassembly 7 is opened, a hinge retainer 14 ensures that the window subassembly 7 remains attached to the wall 5. Other hinge designs will be readily apparent to those skilled in the art in view of the disclosure provided here.

As shown in FIG. 2, an elastomeric seal 6 is preferably adhesively attached to the frame and positioned between the frame and the wall to provide a weather resistant seal and to reduce vibrational noise.

As shown in FIGS. 3, 5, 6A and 6B latch assembly 20 is provided with a latch housing 33, a latch frame consisting of an upper frame member 22 and a lower frame member 23, mounting and support posts 30, 31 32, preferably internally threaded to provide means for securing the latch assembly to the frame base 48 of the window, a catch or latch member 27, a rotor or latch- lock member 28, a fixed member 26 and a pair of torsion springs 24, 25.

Latch member 27 is provided with a latch detent 88 between a pair of latch projections 83, 84, a primary detent 85 formed between projections 93 and 94, a secondary detent 86 formed between projections 94 and 95, and a tertiary detent 87 formed between projections 95 and 96. Rotor or latch-lock member 28 is provided with three flanges, 80, 81 and 82. The torsion spring 25 is positioned around one support post 32, engaging the rotor 28 and biasing it in one direction until the engagement flange 82 of the catch engages latch member 27. The latch member 27 is rotatably mounted to a second support post 31.

Figure 9:
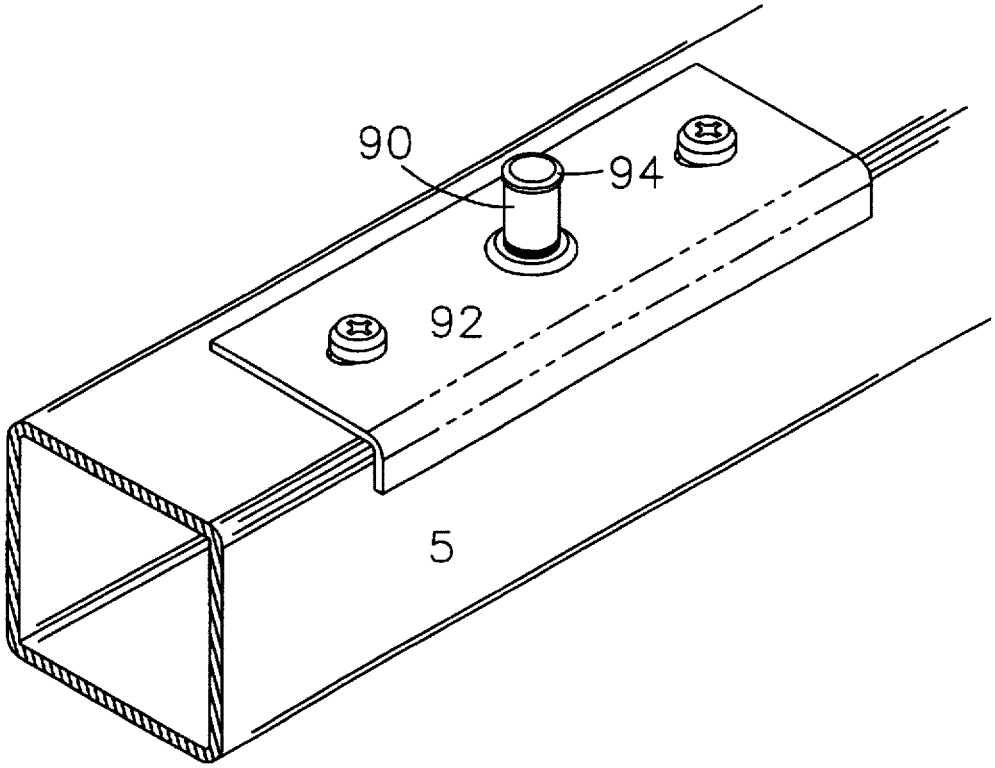
FIG. 9 is a perspective view of the striker pin mounted to the wall.

A striker pin 90 extends into the latch detent 88 of latch assembly 20 through an opening in the lower latch frame 23 and retains the striker pin 90 when the window subassembly 7 is in its normal, closed position. The striker pin 90 can be press fit or welded to a striker plate assembly 92. The striker plate assembly 92 preferably is adjustably mounted for proper alignment of the striker pin with the latch as shown in FIG. 9. The striker pin 90 can optionally be provided with a retaining cap positioned at one end above the rotor engagement flanges 84, 85 for additional retention strength during extreme loading.

Rotation of rotor/latch member 27 against the biasing force of torsion spring 24 brings primary detent 85 and then secondary detent 86 into releasable engagement with flange 82 of rotor 28. Latch detent 88 holds (i.e., releasably captures) the striker pin 90 when either detent 85 or 86 is in engagement with flange 82 of the rotor. Releasing force applied to the rotor sufficient to rotate it against the biasing force of torsion spring 25 will release the latch member 27 by disengaging flange 82 from detents 85, 86. Latch detent 88 is then rotated to a position in which it releases the striker pin to allow the window to be pushed open.

As can best be seen in FIG. 1, the release bar 2 can be seen to extend along most of the bottom of the frame, and is preferably made of extruded aluminum or the like. The release bar is movable between a non-releasing, down position 120 and a releasing, up position 122. A seal 63 may be provided between the release bar and an inner wall 64.

Figure 3:
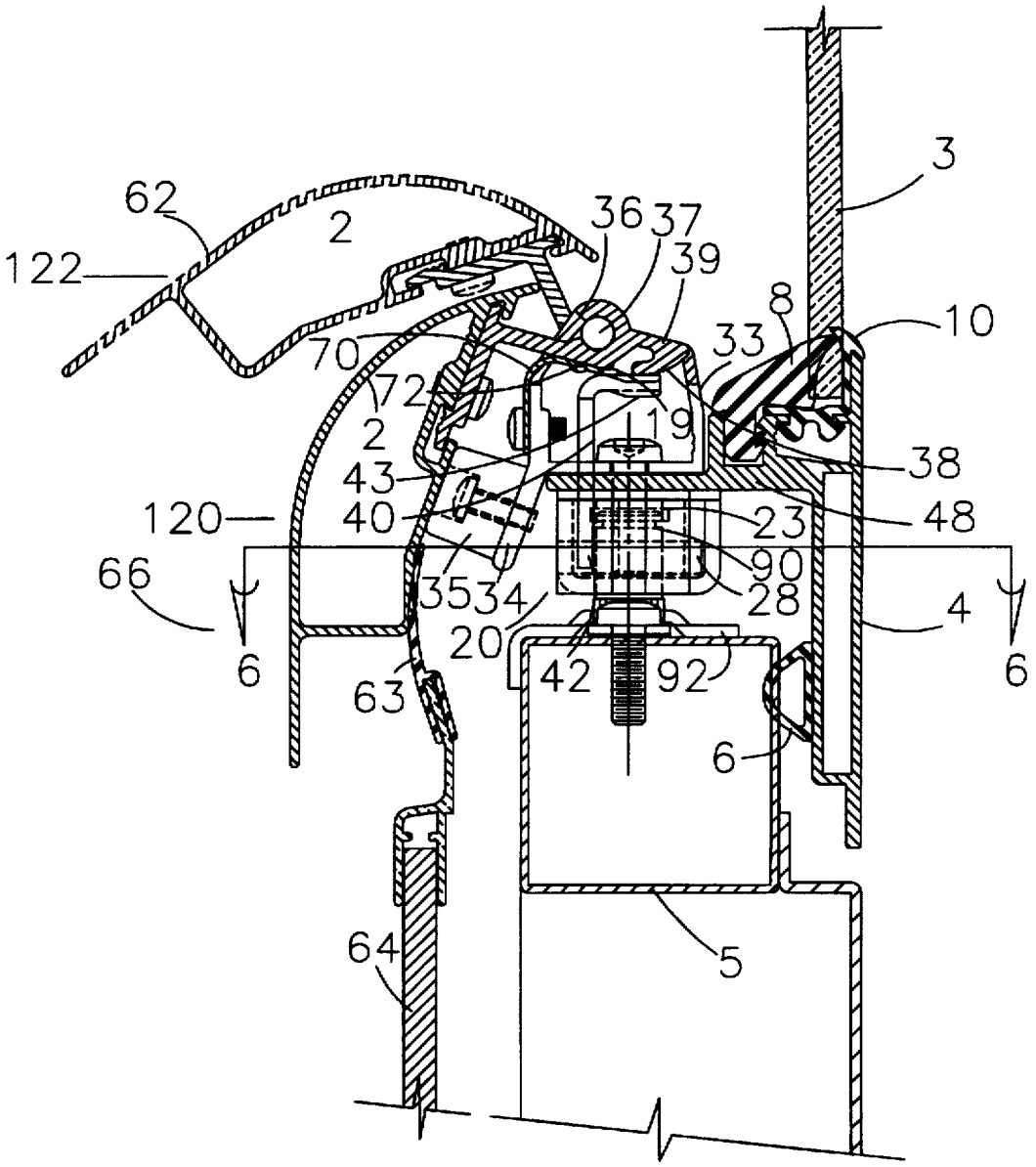
FIG. 3 is a partial cross sectional view of the release bar, latch assembly, trip lever, frame and wall and shows a first preferred embodiment taken along the line 3—3 of FIG. 1.
Figure 4:
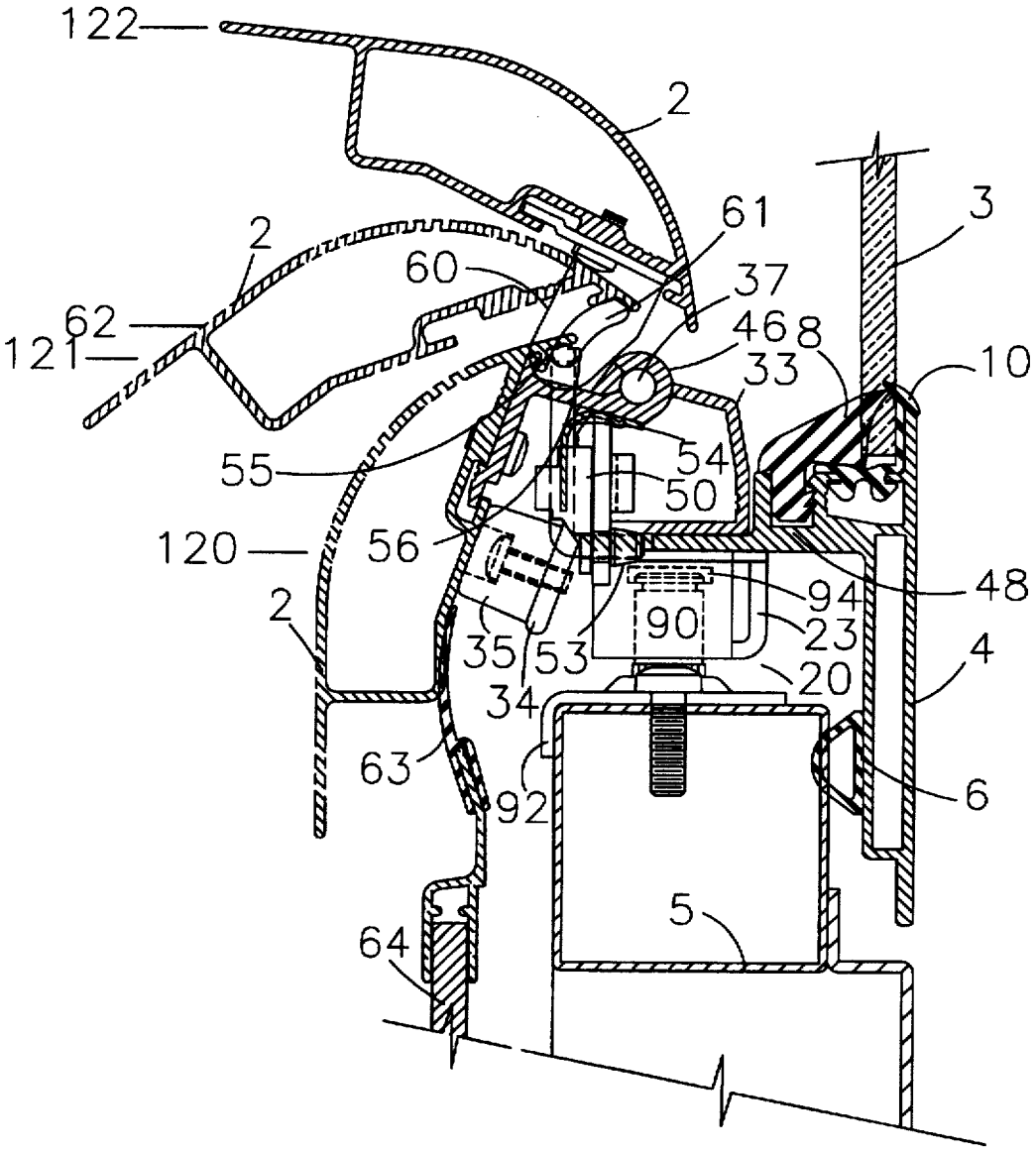
FIG. 4 is a cross sectional view of the release bar, trip lever, frame, wall and the latch frame and latch housing, with the rest of the latch assembly not shown, showing a second preferred embodiment and taken along the line 3—3 of FIG. 1.
Figure 5:
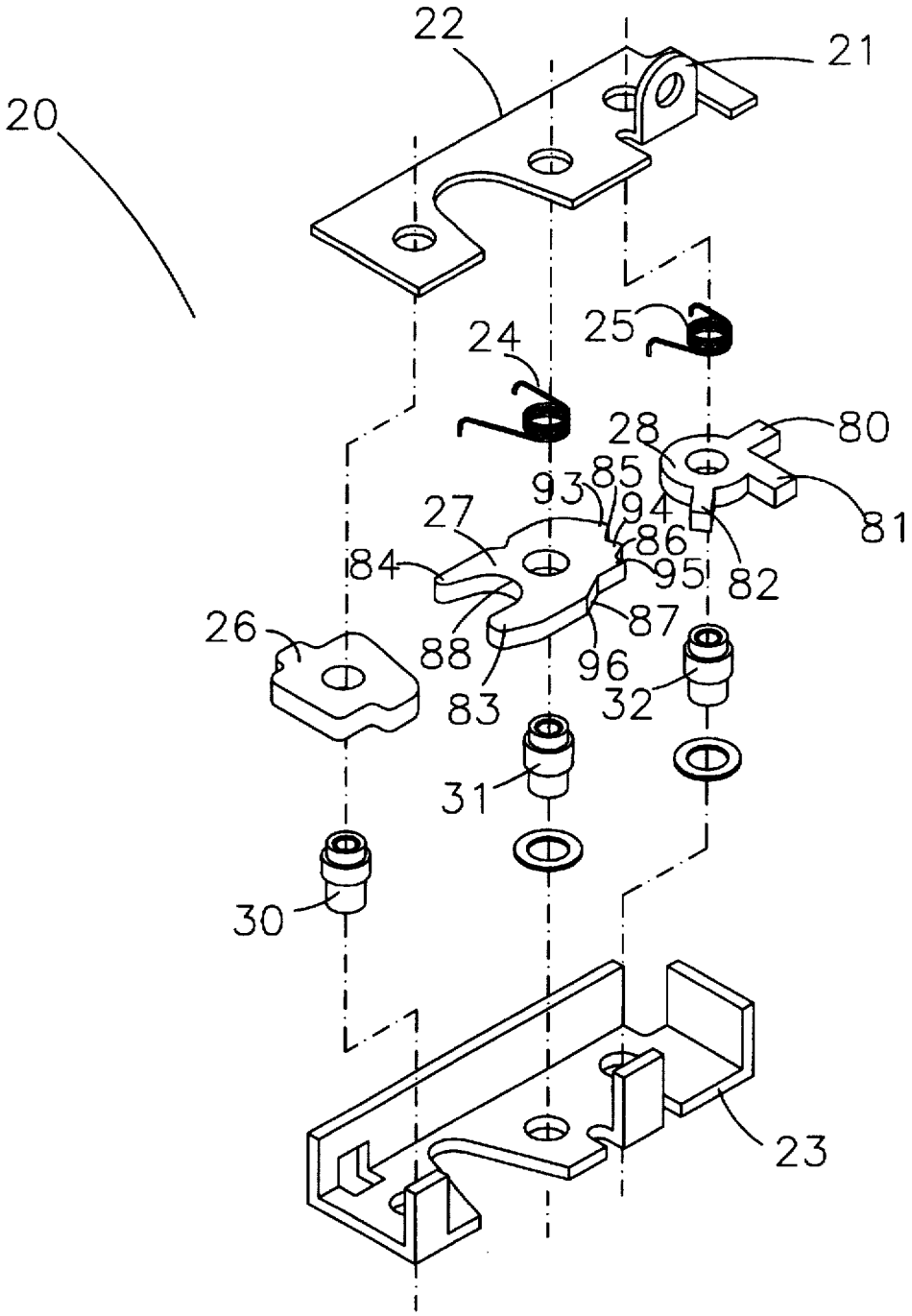
FIG. 5 is an exploded perspective view of the upper and lower latch frame, latch member, latch-lock member and biasing means.
Figure 6A:
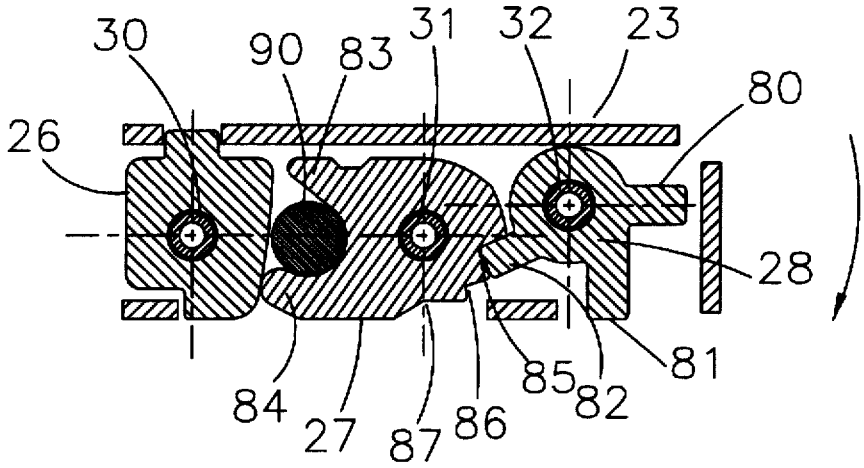
FIG. 6A is a cross sectional view taken along the line 6—6 in FIG. 3 and shows a fixed member, the latch member and latch-lock member in the latching position.
Figure 6B:
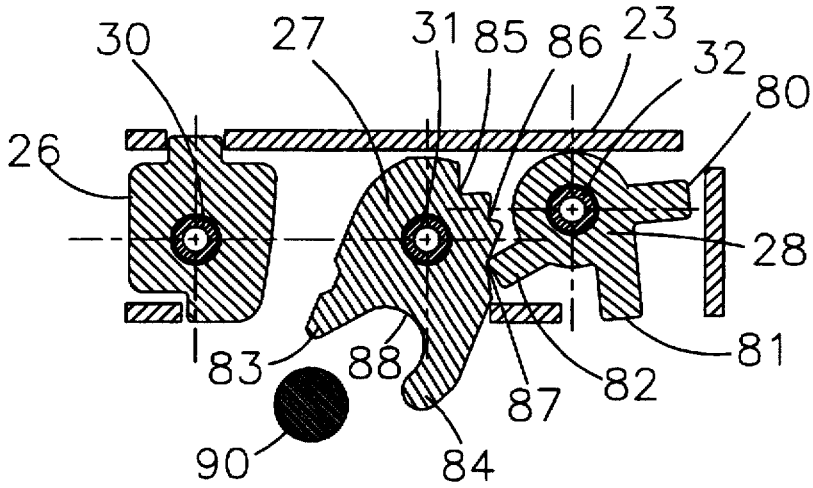
FIG. 6B is a cross sectional view taken along the line 6—6 in FIG. 3 and shows a fixed member, the latch member and latch-lock member in the non-latching position.

FIG. 3 shows a preferred embodiment in which the release bar is pivotally connected to the latch housing 33 by at least one hinge 36 and hinge pin 37, allowing the release bar to pivot relative to the window subassembly. In FIG. 4, a second preferred embodiment, the release bar is again connected to the latch housing by at least one hinge 46 and hinge pin 37. Depending on the size of the window assembly, more than one latch mechanism may be needed. The latch housing provides a structural support and mounting surface for the release bar and other optional components of the window assembly such as a leaf spring and bumper, described below.

An optional, but highly advantageous feature of the invention is a leaf spring 70 mounted on one surface of the latch housing and slidably engaged with the underside of the release bar hinge 36 on the other surface. The leaf spring 70 holds the release bar assembly 66 in a releasing or up position 122, when the release bar 2 is moved away from the frame 4 and the window assembly 1 is released from the wall 5. If the release bar is allowed to move freely when the window is open, the interior or show surface 62 of the release bar can come into contact with the wall 5 of the bus. Operation of the leaf spring prevents the release bar from returning inadvertently, for example, by gravity or otherwise to its non-releasing or down position 120 during opening or closing of the window, thereby preventing scuffing or scratching of the interior or show surface 62 of the release bar assembly. The leaf spring is preferably provided with a detent 72 or other suitable means for producing a tactile signal when the release bar is seated in the up position, for example a snap feeling when the release bar moves into and out of the up position.

Another optional, but highly advantageous feature of the invention is a release bar bumper 35, preferably made of elastomeric resin and positioned on an inboard flange 34 of the latch housing 33. The bumper 35 provides a contact/resting surface for the release bar during the normal, closed, non- releasing position 120.

The window assembly can optionally be provided with a covering or shield formed for example of a flexible plastic, positioned between the release bar and the window, preferably attached to the latch housing 33, designed to prevent foreign objects from interfering with the operation of the latch assembly.

Operation of the release bar 2 releases the latch assembly 20 through a connecting mechanism. As mentioned above this allows the window to be pivotably opened.

Figure 7:
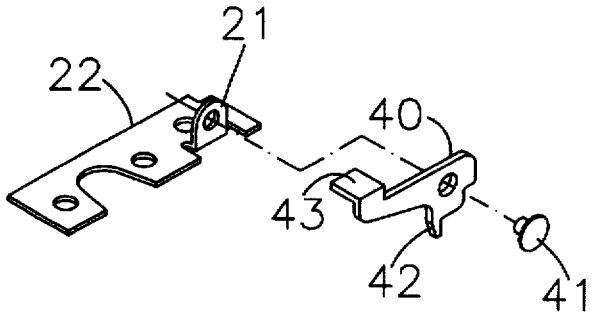
FIG. 7 is an exploded perspective view of one preferred embodiment of the trip lever.

FIGS. 3 and 7 show a first preferred embodiment of the connecting mechanisms between the release bar and the latch assembly. In this embodiment the release bar hinge 36 has a flange 39 extending from a hinge pin 37. The flange is provided with a cam surface 38. A trip lever 40 is rotatably attached to the latch assembly 20 at trip lever receiving flange 21 and is provided with a contact surface 43 facing cam surface 38 and an engagement flange 42 which engages engagement flange 81 of the rotor 28. Raising the release bar from the down position 120 to the up position 122 forces the cam flange 39 of the hinge into contact with the contact surface 43 of the trip lever. The trip lever is forced down, thereby rotating the rotor 28 in a direction opposite the biasing force of the torsion spring 25. As described above, this causes the rotor to release the latch wheel 27 and the latch wheel is allowed to rotate sufficiently to release the striker pin 90 from the latch detent 88. This allows the window subassembly to be opened.

Figure 8:
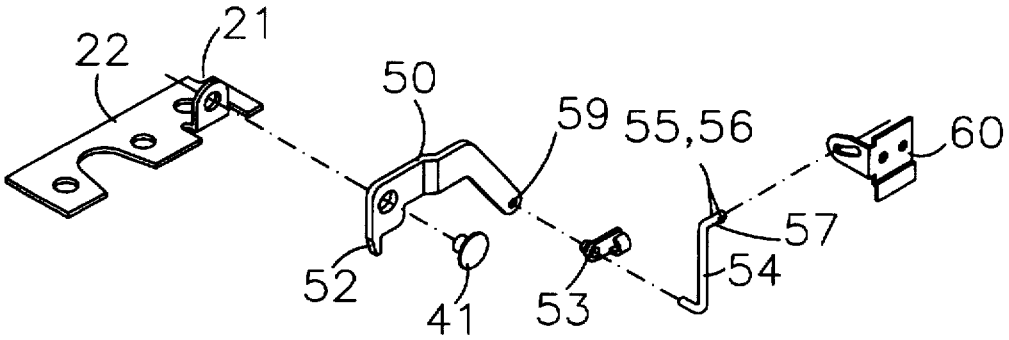
FIG. 8 is an exploded perspective view of a second preferred embodiment of the trip lever and the connection means.

FIGS. 4 and 8 show a second preferred embodiment of the connecting mechanisms between the release bar 2 and the latch assembly 20. In this embodiment a bracket 60 is fixedly attached to the underside of the release bar 2. The bracket is provided with a slot 61. A connecting rod 54 is provided with a bent end 57 which engages and slides in the slot 61. The rod can be provided with means for securing the rod in the slot, such as a pair of axially spaced projections 55, 56 or dog ears extending from the bent end in one direction a distance greater than the width of the slot.

The opposite end of the connecting rod is rotatably attached to a trip lever 50. Preferably the rod is provided with a rod clip 53 which snaps over the rod. The trip lever in this embodiment is provided with a hole 59 for receiving the rod and rod clip. The trip lever 50 is attached to the latch assembly at a trip lever receiving flange 21 and engages the rotor in much the same manner as the previous preferred embodiment.

As best seen in FIG. 4, in accordance with a highly advantageous aspect of this embodiment of the invention, the release bar 2 is movable from a first, closed, non-releasing position 120 to a second, non-releasing position, 121 forcing the bracket 60 to travel and the rod to slide from one end of the slot to the other without the connection means actuating the latch member 27 to move to its non-latching position and release the striker pin 90. This helps prevent an operator from mistakenly thinking he has closed the window simply by moving the release bar down. Release of the striker pin occurs when the release bar is moved from the second, non-releasing position 121 to the final, releasing position 122.

Those who a reskilled in this area of technology will recognize from the foregoing disclosure of the invention and description of preferred embodiments that various modifications and alternative embodiments are possible within the true scope and spirit of the invention. The appended claims are intended to cover all such modifications and alternative embodiments.

I claim:

1. A window assembly for mounting in a wall to non-permanently close an opening in the wall, comprising:

a frame;

a latch assembly mounted on the frame, comprising, a latch member mounted for movement between a latching position and a non-latching position, biasing means for applying biasing force to the latch member toward its non-latching position, a latch-lock member, mounted for movement between a locking position in which it releasably locks the latch member in the latching position, and a non-locking position in which it does not lock the latching member in the latching position; and a release bar assembly comprising a release bar movable between a releasing position and a non-releasing position, a bracket attached to the release bar and having a slot, and a leaf spring for holding the release bar in the releasing position, and connection means for operatively interconnecting the release bar to the latch-lock member to actuate the latch-lock member to release the latch member to its non-latching position upon movement of the release bar to the releasing position.

2. The window assembly of claim 1 further comprising a panel mounted to the frame.

3. The window assembly of claim 1 wherein the biasing means for applying biasing force to the latch member toward its non-latching position is a torsion spring mounted to the latch assembly to bias the latch member in a first rotational direction and a torsion spring mounted to the latch-lock member to bias the latch-lock member in a second, opposite rotational direction.

4. The window assembly of claim 1 wherein the release bar assembly further comprises a hinge fixedly attached to the release bar and the latch assembly, the hinge having a projection and the leaf spring having a detent to receive the projection when the release bar is in the releasing position.

5. The window assembly of claim 1 further comprising a second latch assembly mounted to the frame substantially identical to the first, comprising:

a second latch member mounted for movement between a latching position and a non-latching position, a second biasing means for applying biasing force to the second latch member towards its non-latching position, and a second latch-lock member, mounted for movement between a locking position in which it releasably locks the second latch member in a latching position, and a non-locking position in which it does not lock the second latching member in the latching position, wherein the connection means of the release bar assembly operatively interconnects the release bar to both the first and second latch-lock members to release simultaneously both the first and second latch members upon movement of the release bar to the releasing position.

6. The window assembly of claim 1 wherein the release bar is movable from the non-releasing position to an intermediate position in which the connection means does not actuate the latch-lock member to release the latch member to its non-latching position.

7. The window assembly of claim 1 further comprising a trip lever mounted to a latch frame of the latch assembly, mounted for movement between a non-trip position and a tripping position to move the latch-lock member to a non-locking position.

8. The window assembly of claim 7 wherein the connection means includes a cam surface integral with the release bar and positioned to move the trip lever to the tripping position.

9. The window assembly of claim 7 wherein the release bar assembly further comprises a hinge fixedly attached to the release bar and the latch assembly, the connection means including a projection of the hinge having a cam surface positioned to move the trip lever to the tripping position.

10. The window assembly of claim 7 wherein the connection means includes a rod operatively interconnected to the release bar and positioned to move the trip lever to the tripping position.

11. A window assembly for mounting in a wall to non-permanently close an opening in the wall, comprising:

a frame;

a latch assembly mounted on the frame, comprising a latch member mounted for movement between a latching position and a non-latching position, biasing means for applying biasing force to the latch member toward its non-latching position, and a latch-lock member, mounted for movement between a locking position in which it releasably locks the latch member in the latching position, and a non-locking position in which it does not lock the latching member in the latching position:

a trip lever mounted to a latch frame of the latch assembly, mounted for movement between a non-trip position and a tripping position to move the latch-lock member to a non-locking position, and a release bar assembly comprising a release bar movable between a releasing position and a non-releasing position, a bracket attached to the release bar and having a slot, and connection means for operatively interconnecting the release bar to the latch-lock member to actuate the latch-lock member to release the latch member to its non-latching position upon movement of the release bar to the releasing position including a rod having one end slidably retained in the slot of the bracket and positioned to move the trip lever to the tripping position.

12. The window assembly of claim 11 wherein the rod is secured to the slot in the bracket with a pair of projections and the rod is rotatably secured to the trip lever by a rod clip.

13. The panel assembly of claim 1 further comprising a cushioning stop for the release bar attached to the latch assembly.

14. A window construction mounted in a wall, comprising, in combination:

a panel subassembly mounted to the wall for movement between a closed position and an open position, comprising:

a planar member and a frame extending along at least a portion of a peripheral edge of the planar member, and a hinge attached to a peripheral edge of the frame, hingedly mounting the panel subassembly to the wall;

latching apparatus for releasably latching the panel subassembly in the closed position, comprising:

a fixed member extending from either the panel subassembly or the wall, a latch assembly mounted to the other of the panel subassembly or the wall, comprising:

a latch member mounted for movement between a latching position and a non-latching position, securing the panel subassembly to the fixed member in the latching position, biasing means for applying biasing force to the latch member toward its non-latching position, and a latch-lock member, mounted for movement between a locking position in which it releasably locks the latch member in the latching position and a non-locking position in which it does not lock the latching member in the latching position, a trip lever mounted to the latch assembly; and a release bar assembly comprising:

a release bar movable between a releasing and a non-releasing position, a bracket attached to the release bar and having a slot, and connection means for operatively interconnecting the release bar to the latch-lock member to actuate the latch-lock member to release the latch member from the fixed member upon movement of the release bar to the releasing position, the connection means including a rod having one end slidably retained in the slot of the bracket and positioned to move the trip lever to a tripping position when the release bar is moved to the releasing position.

15. The window construction of claim 14 wherein the release bar is movable from the non-releasing position to an intermediate position in which the connection means does not actuate the latch-lock member, the latch member is in the latching position and the panel subassembly is secured to the fixed member.

16. The window construction of claim 15 wherein the hinge comprises a U-shaped flange unitary with the frame, having a rounded contact surface in a C-shaped flange extending from the wall.

17. The window construction of claim 14 wherein the fixed member has a cap.

18. The window construction of claim 14 wherein the fixed member is adjustably mountable.

19. The window construction of claim 14 wherein the release bar assembly further comprises bias means for holding the release bar in the releasing position.

20. The window construction of claim 19 wherein the bias means of the release bar assembly is a leaf spring mounted to the latch assembly.

21. The window construction of claim 20 wherein the release bar assembly further comprises a hinge fixedly attached to the release bar, having a projection, the leaf spring having a detent to receive the projection when the release bar is in the releasing position.

22. The window construction of claim 14 wherein the connection means includes a cam surface integral with the release bar and positioned to move the trip lever to the tripping position.

23. The window construction of claim 14 wherein the release bar assembly further comprises a hinge fixedly attached to the release bar and the connection means includes a projection of the hinge having a cam surface positioned to move the trip lever to the tripping position when the release bar is moved to the releasing position.

24. The window construction of claim 7 wherein the connection means includes a rod attached at one end to the release bar and positioned to move the trip lever to the tripping position.

25. A vehicle window assembly comprising:

a window subassembly comprising:

glazing panel, and a frame extending along at least a portion of a peripheral edge of the glazing panel;

a wall provided with an opening sized to receive the window subassembly;

a hinge comprising a U-shaped flange extending from the frame toward the wall and provided with a rounded contact surface positioned in a C-shaped flange extending from the wall;

a fixed member attached to the wall and extending into the opening of the wall;

a latch assembly comprising:

a latch frame, comprising upper and lower frame members;

a latch member mounted to the latch frame for movement between a latching position and a non-latching position, having a latch detent receiving the fixed member in the latching position;

a torsion spring for applying biasing force to the latch member toward its non-latching position;

a latch-lock member, mounted for movement between a locking position in which it releasably locks the latch member in the latching position, and a non-locking position in which it does not lock the latching member in the latching position; and a second torsion spring biasing the latch-lock member toward its non-locking position;

a release bar movable between a releasing position and a non-releasing position;

a leaf spring biasing the release bar towards its releasing position;

a bracket attached to the release bar, having a slot;

a connecting rod attached to the bracket, having one end slidably retained in the slot; and a trip lever rotatably attached to the connecting rod, which upon movement of the release bar from the non-releasing position to the releasing position actuates the latch-lock member to release the latch member from the fixed member.

* * * * *